US008826689B2

(12) United States Patent
Kim

(10) Patent No.: US 8,826,689 B2
(45) Date of Patent: Sep. 9, 2014

(54) AIR CONDITIONER AND OUTDOOR UNIT

(75) Inventor: Chan Gu Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 223 days.

(21) Appl. No.: 13/202,783

(22) PCT Filed: Feb. 26, 2010

(86) PCT No.: PCT/KR2010/001215

§ 371 (c)(1),
(2), (4) Date: Aug. 23, 2011

(87) PCT Pub. No.: WO2010/098610

PCT Pub. Date: Sep. 2, 2010

(65) Prior Publication Data

US 2011/0314861 A1 Dec. 29, 2011

(30) Foreign Application Priority Data

Feb. 26, 2009 (KR) ..... 10-2009-0016171
Feb. 26, 2009 (KR) ..... 10-2009-0016186

(51) Int. Cl.
*F25D 17/06* (2006.01)

(52) U.S. Cl.
USPC ..... 62/426; 62/498

(58) Field of Classification Search
CPC ..... F24F 1/26; F24F 13/20; F24F 1/46; F24F 1/32; F24F 1/56
USPC ..... 62/298, 426, 498, 126, 222, 259.1; 312/101, 285
See application file for complete search history.

(56) References Cited

U.S. PATENT DOCUMENTS 2,708,833 A * 5/1955 Nigro ..... 62/262
2,708,835 A * 5/1955 Nigro ..... 62/262
3,802,216 A * 4/1974 Brandimarte ..... 62/262
5,101,712 A * 4/1992 Dean, Jr. ..... 454/341

FOREIGN PATENT DOCUMENTS

| | | |
|---|---|---|
| CN | 1568415 | 1/2005 |
| JP | 07-055197 | 3/1995 |
| JP | 2000-097453 | 4/2000 |
| JP | 2000-179896 | 6/2000 |
| KR | 10-2007-0010278 | 1/2007 |

OTHER PUBLICATIONS

International Search Report issued in PCT Application No. PCT/KR2010/001215 dated Sep. 17, 2010.

* cited by examiner

*Primary Examiner* — Mohammad M Ali
(74) *Attorney, Agent, or Firm* — KED & Associates, LLP

(57) ABSTRACT

The present invention relates to an air conditioner and to an outdoor unit. More particularly, the present invention relates to an air conditioner having a plurality of indoor units, wherein said air conditioner comprises a distribution unit which is accommodated in an outdoor unit of the air conditioner and connected to the outdoor unit and indoor units, or which is separated from the outdoor unit and connected to the outdoor unit and indoor units to distribute refrigerant to the plurality of indoor units.

18 Claims, 14 Drawing Sheets

(a)

(b)

AIR CONDITIONER AND OUTDOOR UNIT

TECHNICAL FIELD

The present invention relates to an air conditioner which controls a room space to have temperature, humidity, air flow distributions suitable for human activities for maintaining the room space in a comfortable state. In more detail, the present invention relates to an air conditioner having a plurality of indoor units, including a distribution unit mounted to an outdoor unit and connected to the outdoor unit and the indoor units or connected to the outdoor unit and the indoor units in a state the distribution unit is separated from the outdoor unit, for distributing refrigerant to the plurality of indoor units.

BACKGROUND ART

Generally, the air conditioner is a room cooling/heating system for cooling a room by repetitive operation of drawing warm air from the room, heat exchanging the warm air with a low temperature refrigerant, and discharging the air to the room, or heating the room by reverse operation, provided with a compressor—a condenser—an expansion valve—an evaporator to form a cycle.

Currently, besides the heating/cooling of the space to be air conditioner, the air conditioner has additional functions of an air cleaning function in which polluted air is drawn from the room, the polluted air is filtered, and the filtered air is supplied to the room again, a dehumidifying function in which humid air is circulated, dehumidified and supplied to the room again, and the like.

In the air conditioners, there are a separate type air conditioner in which the outdoor unit and the indoor unit are separated from each other, and a package type air conditioner the outdoor unit and the indoor unit are provided in one unit of air conditioner.

Recently, there is a multi-air conditioner in which a plurality of the indoor units are connected to one outdoor unit to share the outdoor unit.

The multi-air conditioner can provide an effect of using a plurality of related art air conditioners, and the user can add the indoor unit if required.

The outdoor unit of the air conditioner is provided with an outdoor unit heat exchanger for making the refrigerant to heat exchange with the outside air where the outdoor unit is installed and a compressor.

Accordingly, a process can be repeated, in which the refrigerant circulating the indoor units is collected to the same outdoor unit and distributed to the indoor units through a compression process and a condensing process (when the room is cooled) again.

The refrigerant distribution process can be performed by the compressor or the outdoor heat exchange provided with, not a distribution pipe having branches as many as a number of the indoor units, but an additional distribution unit which carries out the refrigerant collection and distribution.

The distribution unit connects the indoor units to the outdoor unit and for collecting the refrigerant to the compressor in each indoor unit or the outdoor unit and distributing to the indoor units having different cooling conditions.

Accordingly, it is required that the indoor units and the distribution unit are connected with refrigerant supply pipes and refrigerant return pipes.

The outdoor unit is provided with a fan for making the outdoor air to heat exchange with the refrigerant to condense or evaporate the refrigerant with the air drawn by the outdoor unit. Therefore, the outdoor unit can be installed taking an air blow direction of the fan into account. That is, the outdoor unit can be installed such that an air flow direction from the outdoor unit is fixed.

DISCLOSURE OF INVENTION

Technical Problem

Thus, the outdoor unit is installed taking an air discharge direction of the outdoor unit into account. If the distribution unit in the outdoor unit is installed in a direction different from a direction of installation of the indoor unit, it is required that a refrigerant pipe line connecting the distribution unit to the indoor unit is lead around the outdoor unit.

Thus, if the distribution unit is fixed to the outdoor unit and the refrigerant pipe connected to the distribution unit is lead around the outdoor unit, the refrigerant pipe is bent a plurality of times to cause flow resistance of the refrigerant, making energy efficiency of the air conditioner poor, and causing waste of the refrigerant pipe connecting the indoor unit to the outdoor unit.

Moreover, while two refrigerant pipe lines are required for connecting the outdoor unit to the distribution unit, at least two refrigerant pipe lines are required for connecting the distribution unit to each of the plurality of the indoor units. Therefore, if the distribution unit is fixed to the outdoor unit, The refrigerant pipe lines branched from the outdoor unit and lead to the plurality of indoor units becomes complicate and lengthy, making a poor outside appearance.

Technical Solution

To solve the problems, an object of the present invention is to provide an air conditioner having a distribution unit which can be installed in a direction facing an installed direction of the indoor unit regardless of an installed direction of an outdoor unit.

Another object of the present invention is to provide an air conditioner having a distribution unit which can be dismounted from an outdoor unit.

That is, another object of the present invention is to provide an air conditioner having a plurality of indoor units having a distribution unit which is installed in a state mounted to the outdoor unit and connected to the outdoor unit and the indoor units, or installed separate from the outdoor unit and connected to the outdoor unit and the indoor units, for distribution of the refrigerant to the plurality of indoor units.

To achieve these objects and other advantages and in accordance with the purpose of the invention, as embodied and broadly described herein, an air conditioner includes at least one indoor unit, an outdoor unit having a compressor and an outdoor unit housing, and a distribution unit having an indoor side connection unit to be connected to the indoor unit and an outdoor side connection unit to be connected to the outdoor unit, wherein the distribution unit is mounted to, the outdoor unit detachably, or a mounting surface in a state the distribution unit is separate from the outdoor unit.

The distribution unit includes a distribution unit housing which forms an exterior of the distribution unit, and the distribution unit housing is detachably mounted to a recess in an outside of the outdoor unit housing.

The distribution unit housing has a shape in conformity with the recess in the outdoor unit housing.

The recess in the outdoor unit housing is formed at one of corners of the outdoor unit housing.

The corner of the outdoor unit housing having the recess formed therein is in the vicinity of a mounting position of he compressor of the outdoor unit.

The outdoor side connection unit is provided to an outside of the distribution unit mounted to the recess, and includes an outdoor side high pressure socket and an outdoor side low pressure socket, and a pipe connection unit is provided to an outside of the outdoor unit housing, the pipe connection unit having a high pressure socket and a low pressure socket for connection to the outdoor side high pressure socket and the outdoor side low pressure socket.

The pipe connection unit of the outdoor unit is provided to the outside of the outdoor unit housing which is flush with the outside of the distribution unit having the outdoor side connection unit.

The distribution unit housing has a plurality of fastening holes formed therein for fastening mounting brackets for mounting the distribution unit to the mounting surface in the state the distribution unit is separated from the outdoor unit housing.

In the meantime, the distribution unit is detachably mounted to the outside of the outdoor unit housing.

The outdoor unit includes the pipe connection unit to be connected to the distribution unit, wherein the pipe connection unit is provided the outside of the outdoor unit housing in the vicinity of a mounting position of the compressor.

The pipe connection unit includes the high pressure socket and the low pressure socket having different distances from edges of the outdoor unit housing.

The distribution unit includes fastening ribs formed on opposite edges in a length direction of the distribution unit for mounting the distribution unit to the outdoor unit housing or to the mounting surface in a state the distribution unit is separated from the outdoor unit housing.

The outdoor unit housing includes a mounting member provided to the outside thereof, the mounting member having a top side opening for holding the distribution unit.

The mounting member includes a stopper for supporting a bottom of the distribution unit, and one pair of holding ribs which are extensions from opposite ends of the stopper for surrounding opposite edges of the distribution unit.

The fastening rib has a plurality of fastening holes formed therein for pass through of fastening pieces respectively for mounting the distribution unit to the outdoor unit housing or to the mounting surface in the state the distribution unit is separated from the outdoor unit housing.

The pipe connection unit is provided to the outside of the outdoor unit housing in the vicinity of the compressor for connection to the distribution unit, and the distribution unit has a recess for placing the pipe connection unit therein.

The distribution unit includes a plurality of electronic expansion valves, and a controller is provided in the outdoor unit for controlling the electronic expansion valves, and both the outdoor unit housing and the distribution unit have wire openings provided therein respectively for pass through of connection wires for connection to the controller and the electronic expansion valves, wherein the wire openings are provided at positions of the outdoor unit and the distribution unit facing each other when the distribution unit is mounted to the outdoor unit.

In another aspect of the present invention, an outdoor unit of an air conditioner includes a compressor for compressing refrigerant, an outdoor heat exchanger for condensing or evaporating the refrigerant according to operation conditions of at least one indoor unit, a fan for blowing air for heat exchange with the refrigerant, an outdoor unit housing for housing the compressor, the outdoor heat exchanger and the fan therein, and a distribution unit for distributing refrigerant to the at least one indoor unit, wherein the distribution unit is mounted to the outdoor unit detachably.

The distribution unit is mounted to a recess in an outside of the outdoor unit housing detachably.

The distribution unit is mounted to a mounting member provided to an outside of the outdoor unit housing, having a top side opening for holding the distribution unit.

Advantageous Effects

The present invention has following advantageous effects.

The selection of the mounting position of the distribution unit which distributes refrigerant to the indoor units installed in spaces to be air conditioned without restriction permits to reduce flow resistance of the refrigerant since refrigerant pipes branched from the distribution unit and connected to the indoor units.

Since the mounting position of the distribution unit which distributes refrigerant to the indoor units can be selected, lengths of the refrigerant pipes used for mounting an air conditioning system can be minimized according to the spaces to be air conditioned in which the indoor units are installed, and a pipe line arrangement in the vicinity of a mounting place of the outdoor unit can be simplified.

Since a distribution unit good for a number of the indoor units connected to one outdoor unit can be provided, a cost can be reduced.

Since the high pressure socket and the low pressure socket have different distances from edges of the outdoor unit, the connection pipes can be configured brief as other sockets do not interfere with connection paths of the connection pipes.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIGS. 2A and 2B illustrate perspective views of a mounted state and a dismounted state of a distribution unit to/from an outdoor unit in accordance with a preferred embodiment of the present invention respectively, wherein FIG. 2A illustrates the mounted state of the distribution unit in a recessed housing space in an outdoor unit housing, and FIG. 2B illustrates the dismounted state of the distribution unit from the recessed housing space in the outdoor unit housing.

FIGS. 3A and 3B illustrate perspective views of a mounted state and a dismounted state of a distribution unit to/from an outdoor unit in accordance with another preferred embodiment of the present invention respectively, wherein FIG. 3A illustrates the mounted state of the distribution unit in a recessed housing space in an outdoor unit housing, and FIG. 3B illustrates the dismounted state of the distribution unit from the recessed housing space in the outdoor unit housing.

FIGS. 4A and 4B illustrate perspective views of a mounted state and a dismounted state of a distribution unit to/from an outdoor unit in accordance with another preferred embodiment of the present invention respectively, wherein FIG. 4A illustrates the mounted state of the distribution unit in a recessed housing space in an outdoor unit housing, and FIG. 4B illustrates the dismounted state of the distribution unit from the recessed housing space in the outdoor unit housing.

BEST MODE

Reference will now be made in detail to the specific embodiments of the present invention, examples of which are illustrated in the accompanying drawings. Wherever possible, the same reference numbers will be used throughout the drawings to refer to the same or like parts.

Figure 1:
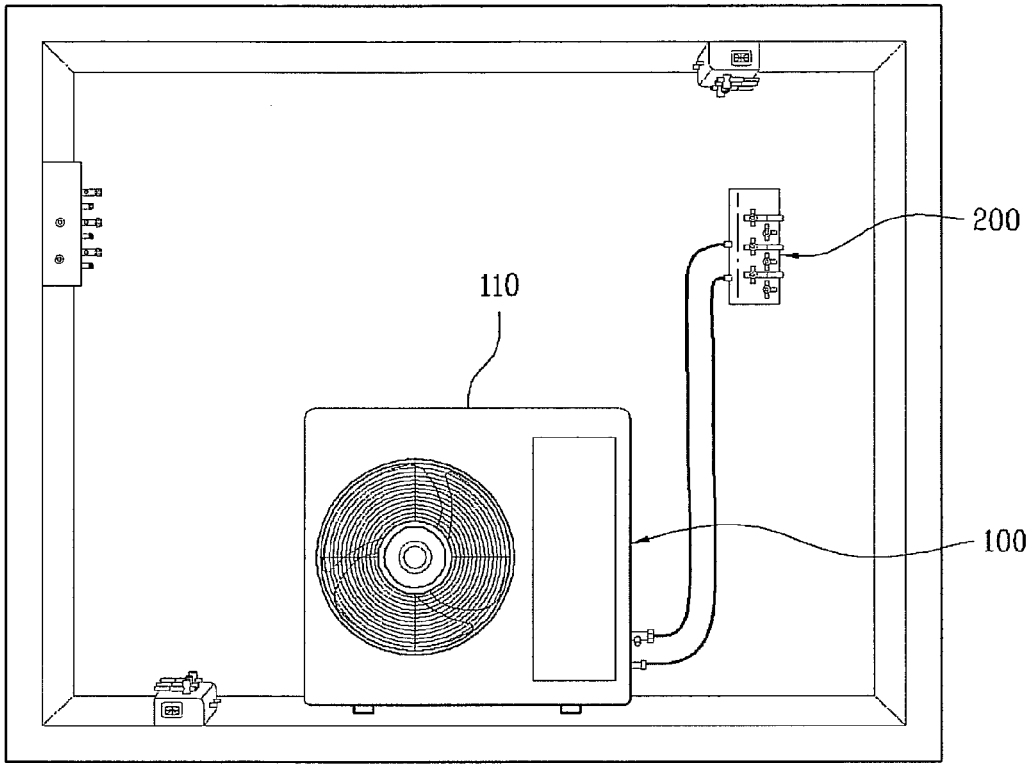
FIG. 1 illustrates a diagram showing examples of various installation positions of a distribution unit to be connected to an outdoor unit and indoor units of an air conditioner in accordance with a preferred embodiment of the present invention.

FIG. 1 illustrates a diagram showing examples of various installation positions of a distribution unit to be connected to an outdoor unit and indoor units of an air conditioner in accordance with a preferred embodiment of the present invention.

The an air conditioner in accordance with a preferred embodiment of the present invention includes a plurality of indoor units each having an indoor heat exchanger installed in a space to be air conditioned, a compressor (not shown) for compressing refrigerant, an outdoor unit 100 having an outdoor heat exchanger (not shown) for making refrigerant to heat exchange with outdoor air and an outdoor unit housing 110 which houses the compressor and the outdoor heat exchanger, and a distribution unit 200 mounted to the outdoor unit 100 housed therein and connected to the outdoor unit 100 and the indoor units, or mounted separate from the outdoor unit 100 and connected to the outdoor unit 100 and the indoor units for distribution of refrigerant to the indoor units.

FIG. 1 shows that the distribution unit 200 can be mounted to different positions depending on positions of the space to be air conditioned in which the indoor unit (not shown) is mounted therein and installation environments of the air conditioner. That is, the distribution unit 100 can be mounted to a ceiling, a bottom or vertical walls of an outdoor space having the outdoor unit 100 installed therein.

Referring to FIG. 1, though the distribution unit 200 can be connected to the outdoor unit 100 and the indoor unit in a state separated from the outdoor unit 100, at user's option, the distribution unit 200 can be connected to the outdoor unit 100 and the indoor unit in a state housed in the outdoor unit 100 for distribution of the refrigerant to the indoor units.

Figure 3:
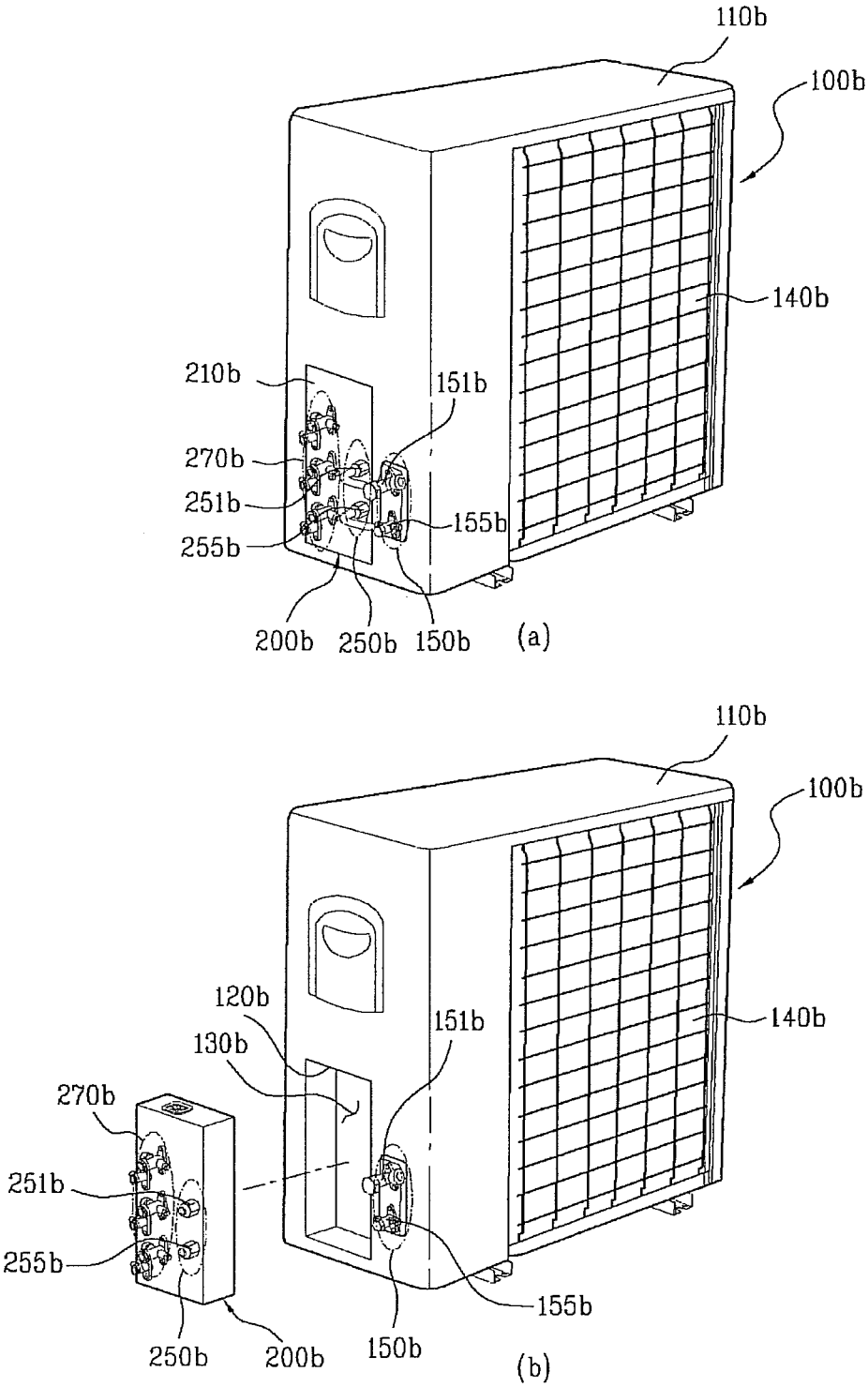
Figure 4:
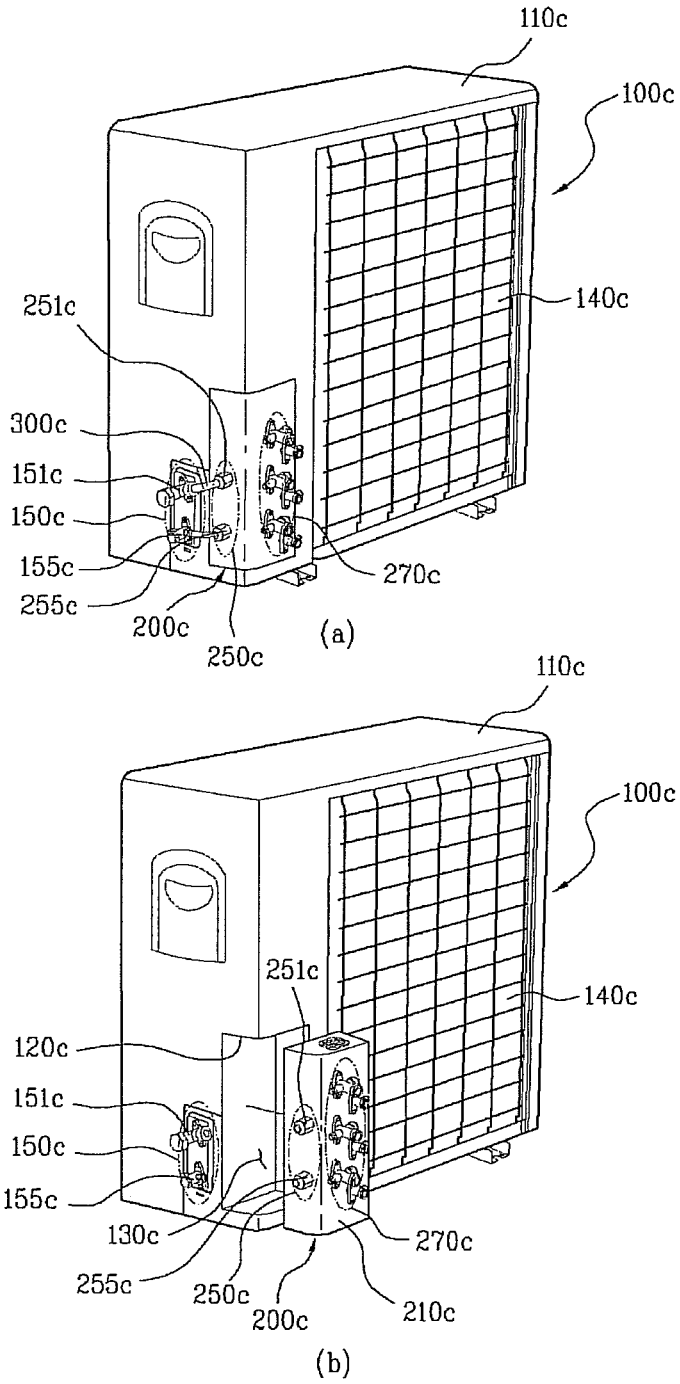

Methods for mounting the distribution unit 200 in state the distribution unit 200 is mounted to the outdoor unit 100 will be described with reference to FIGS. 2 to 4.

FIGS. 2A and 2B illustrate perspective views of a mounted state and a dismounted state of a distribution unit to/from an outdoor unit in accordance with a preferred embodiment of the present invention respectively, wherein FIG. 2A illustrates the mounted state of the distribution unit 200*a* in a recessed housing space 130*a* in an outdoor unit housing 110*a*, and FIG. 2B illustrates the dismounted state of the distribution unit 200*a* from the recessed housing space 130*a* in the outdoor unit housing 110*a*.

Referring to FIGS. 2A and 2B, the outdoor unit housing 110*a* forms an exterior of the outdoor unit 100*a*. The outdoor unit housing 110*a* is hexahedral substantially, and houses a compressor 170 for compressing refrigerant, an accumulator 190, an outdoor heat exchanger 140 for making the refrigerant to heat exchange with outdoor air, and a control unit (not shown) for controlling an electronic expansion valve 260 to be described later (See FIG. 6).

The distribution unit 200*a* is mounted in a state the distribution unit 200*a* is mounted to the outdoor unit 100*a* as follows. The distribution unit 200*a* has a distribution unit housing 210*a* which forms an exterior of the distribution unit 200*a* and is seated in the housing space 130*a* in an outside of the outdoor unit housing 110*a*.

The housing space 130*a* can be a space formed of a recess 120*a* in the outdoor unit housing 110*a*. FIG. 2B illustrates a case the housing space is formed in a backside of the outdoor unit housing 110*a*.

Figure 2:
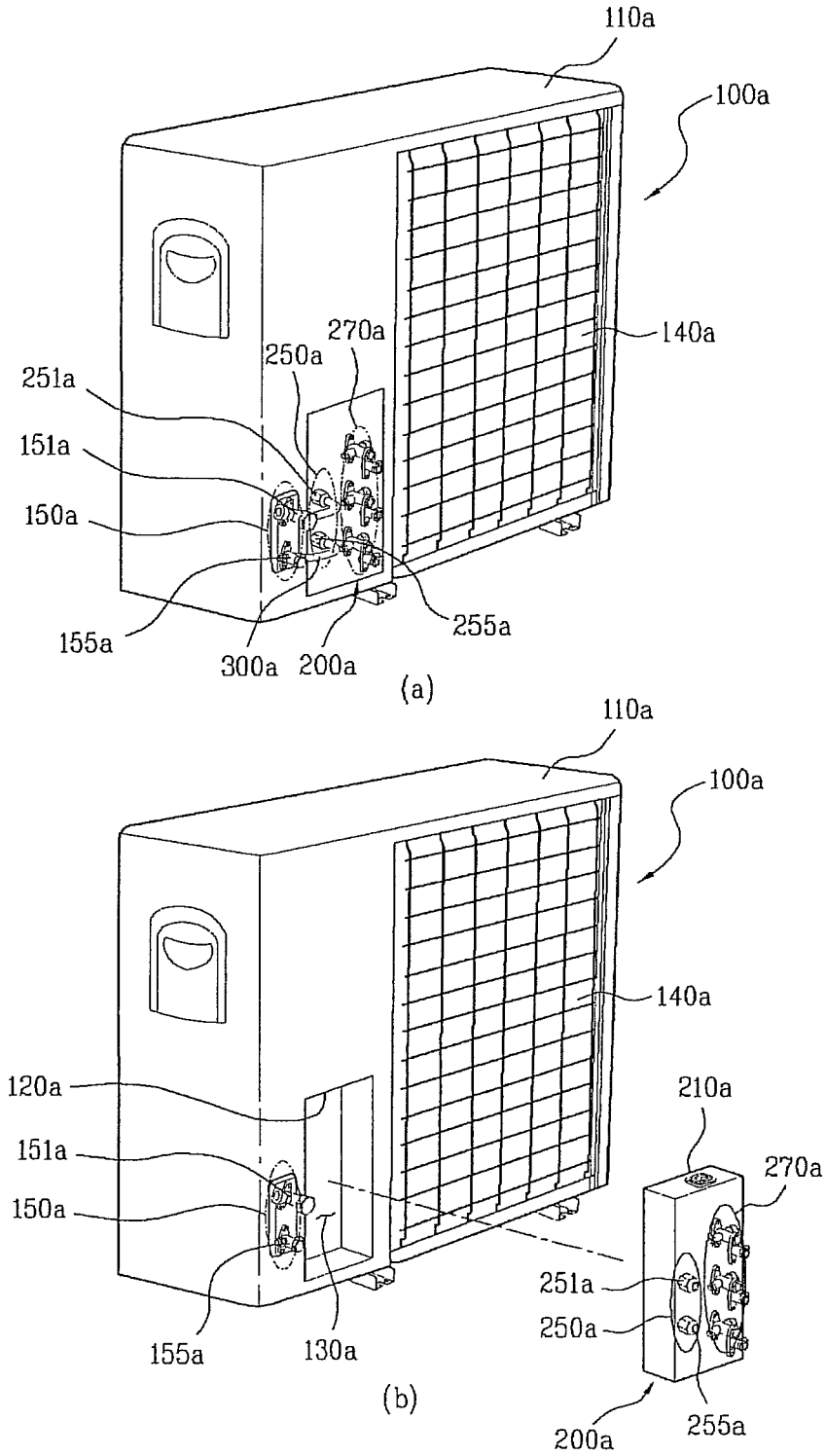

Referring to FIG. 2B, the housing space 130*a* is a recess 120*a* in an outside of the outdoor unit housing 110*a*. The recess 120*a*, being a portion of the outside of the outdoor unit housing 110*a* recessed into the outdoor unit housing 110*a*, may or may not be formed such that the distribution unit 200*a* can be projected beyond the outdoor unit housing 110*a* as shown in FIG. 2.

In order to mount the distribution unit 200*a* not to be projected beyond the outdoor unit housing 110*a* in a state the distribution unit 200*a* is mounted to the outdoor unit housing 110*a*, but to be flush with outdoor unit housing 110*a*, it is possible that the distribution unit housing 210*a* has a shape in conformity with the recess 120*a* in the outdoor unit housing 110*a*.

The distribution unit 200*a* connects the outdoor unit 100*a* to the indoor units, for distribution of the refrigerant to the indoor units.

Therefore, the outdoor unit 100*a* includes a pipe connection unit 150*a* having a high pressure socket 151*a* and a low pressure socket 155*a* for connecting the compressor (not shown) and the outdoor heat exchanger 140*a* in the outdoor unit 100*a* to the distribution unit 200*a*, and the distribution unit 200*a* includes an outdoor side connection unit 250*a* having an outdoor side high pressure socket 251*a* and an outdoor side low pressure socket 255*a* for connection to the pipe connection unit 150*a* having the high pressure socket 151*a* and the low pressure socket 155*a*.

The high pressure socket 151*a* is a portion to be connected to the compressor, and the low pressure socket 155*a* is a portion to be connected to the outdoor heat exchanger, and the sockets of the distribution unit are called as the outdoor side high pressure socket 251*a* and the outdoor side low pressure socket 255*a* in a sense that the sockets 251*a* and 255*a* are connected to the outdoor unit 100*a*.

Since the distribution unit 200*a* serves to distribute refrigerant from the outdoor unit 100*a*, the distribution unit 200*a* has a plurality of indoor side connection units 270*a* having indoor side high pressure sockets and indoor side low pressure sockets for pipe lines to be connected to the indoor units.

A likely, the socket for distributing the refrigerant through the high pressure socket 151*a* of the outdoor unit 100*a* and the distribution unit is called as the indoor side high pressure socket and the socket for distributing the refrigerant through the low pressure socket of the outdoor unit and the distribution unit is called as the indoor side low pressure socket.

The indoor side connection units 270*a* each having the indoor side high pressure socket and the indoor side low pressure socket can be provided in plural. That is, if the user uses a plurality of the indoor units, a plurality of the indoor side connection units 270*a* can be provided for enabling the user to connect a plurality of the indoor unit thereto within a range of a capacity of the compressor. The indoor side connection units 270*a* will be described additionally, with reference to FIG. 5, later.

Since the distribution unit 200*a* is detachably mounted to the housing space 130*a* recessed in the outdoor unit housing 110*a*, a number of the indoor side connection units 270*a* of the distribution unit 200*a* are selected before the distribution unit 200*a* is mounted to the outdoor unit 100*a*. As described later, the distribution unit 200*a* is required to a number of expansion valves corresponding to a number of the indoor side connection unit 270*a*, it is not necessary that the distribution unit 200*a* has a number of the indoor side connection units greater than a user's requirement.

Therefore, according to the user's requirement, the distribution unit 200*a* having a required number of the indoor side connection units 270*a* can be selected within the range of compression capacity of the compressor.

That is, it is advantageous in that, though FIG. 2 illustrates the distribution unit 200*a* having three indoor side connection units in total, the user who requires one or two indoor side connection unit may provide the distribution unit, not having three indoor side connection units, but having one or two indoor side connection unit, and, if the indoor side connection units are required later, the user may buy, not an entire indoor unit, but the distribution unit having the three indoor side connection units.

Of course, above case is viable only when the compressor capacity of the outdoor unit can operate three indoor units.

Referring to FIG. 2 again, description of the distribution unit of the outdoor unit of the air conditioner in accordance with the present invention will be continued.

The pipe line connection unit 150*a* of the outdoor unit 100*a* and the outdoor side connection unit 250*a* can be connected with a connection pipe 300*a*. The connection pipe 300*a* connects sockets of the pipe connection unit 150*a* and the outdoor side connection unit 250*a* for making the refrigerant to flow therethrough.

Referring to FIG. 2 again, the high pressure socket 151*a* and the low pressure socket 155*a* of the pipe connection unit 150*a* can be provided to an outside of the outdoor unit housing 110*a* flush with the outside of the distribution unit 200*a* having the outdoor side high pressure socket 251*a* and the outdoor side high pressure socket 255*a*.

If the high pressure socket 151*a* and the low pressure socket 155*a* are flush with the outside of the distribution unit 200*a* having the outdoor side high pressure socket 251*a* and the outdoor side high pressure socket 255*a* of the outdoor unit housing 110*a*, pipes exposed to an outside of the distribution unit 200*a* can be simplified, lengths of the connection pipes that connect the pipe connection units to the outdoor side connection units can be minimized, and assembly can be made convenient.

If the pipe connection unit 150*a* and the outdoor side connection unit 250*a* are formed at positions where the connection pipes for connecting the pipe connection unit 150*a* to the outdoor side connection unit 250*a* are required to be bent at 90 degrees for making required connection, a mounting process will be complicate and an outside appearance will be poor.

Accordingly, if the distribution unit housing 210*a* is formed to have a configuration in conformity with the housing space 130*a* and the outside of the distribution unit housing 210*a* exposed to a outside is configured to be flush with the outside of the outdoor unit housing, the lengths of the connection pipes that connect the outdoor unit to the distribution unit can be minimized and convenience of assembly thereof can be improved.

FIGS. 3A and 3B illustrate perspective views of a mounted state and a dismounted state of a distribution unit to/from an outdoor unit in accordance with another preferred embodiment of the present invention respectively, wherein FIG. 3A illustrates the mounted state of the distribution unit 200*b* in a recessed housing space 130*b* in an outdoor unit housing 110*b*, and FIG. 3B illustrates the dismounted state of the distribution unit 200*b* from the recessed housing space 130*b* in the outdoor unit housing 110*b*.

Description of parts of the outdoor unit and the distribution unit of an air conditioner of the present invention in FIGS. 3A and 3B identical to the parts in FIGS. 2A and 2B will be omitted.

The embodiment in FIG. 3A or 3B suggests a recessed housing space 130*b* in an outdoor unit housing 110*b* formed, not in a back side, but in a side of the outdoor unit for mounting the distribution unit 200*b* therein. In the embodiment illustrated in FIG. 3B, the recessed housing space 130*b*, i.e., a space formed by a recess 120*b* is a side of the outdoor unit housing 110*b*.

Once a position of the pipe connection unit 150*b* having the high pressure socket 151*b* and the low pressure socket 155*b* for connecting the compressor to the outdoor heat exchanger of the outdoor unit is fixed, the outdoor side connection unit which is connected to the pipe connection unit with the connection pipe can be made configured to be flush. Therefore, as shown in FIGS. 3A and 3B, if the pipe connection unit 150*b* of the outdoor unit is provided to the side of the outdoor unit housing 110*b*, a position of the recess 120*b* is determined such that the outdoor side connection unit 250*b* of the distribution unit 200*b* is positioned in the vicinity of the pipe connection unit 150*b* of the outdoor unit 100*b*.

The outdoor unit 100*b* and the distribution unit 200*b* shown in FIGS. 3A and 3B can also be connected with one pair of connection pipes which connect the pipe connection unit 150*b* to the outdoor side connection unit 250*b*, detachably.

FIGS. 4A and 4B illustrate perspective views of a mounted state and a dismounted state of a distribution unit 200*c* to/from an outdoor unit 100*c* of an air conditioner in accordance with another preferred embodiment of the present invention respectively, wherein FIG. 4A illustrates the mounted state of the distribution unit 200*c* in a recessed housing space 130*c* in an outdoor unit housing 110*c*, and FIG. 4B illustrates the dismounted state of the distribution unit 200*c* from the recessed housing space 130*c* in the outdoor unit housing 110*c*.

Description of the parts of the embodiment illustrated in FIGS. 4A and 4B identical to the parts of the embodiment described with reference to FIGS. 2A, 2B, 3A, and 3B will be omitted.

Referring to FIGS. 4A and 4B, the recess 120*c* of the outdoor unit housing 110*c* to which the distribution unit 200*c* is mounted may be formed to one of corners of the outdoor unit housing 110*c*. In the embodiment shown in FIGS. 4A and 4B, the recess 120*c* is shown formed in a lower portion of one of vertical direction corners of a back side of the outdoor unit 100*c*.

The recess 120*c* is formed in the lower portion of one of vertical direction corners of a back side of the outdoor unit 100*c* for positioning the recess 120*c* in the outdoor unit housing 110*c* in the vicinity of the compressor of the outdoor unit.

Referring to FIGS. 4A and 4B, since the compressor mounted in the outdoor unit housing 110*c* is positioned at an inside region of the outdoor unit housing 110*c* where no outdoor air passes through the outdoor heat exchanger, if the position of the recess 120*c* does not interfere with the heat exchange by the air flow through the outdoor heat exchanger, the recess 120*c* may be formed in the vicinity of the compressor.

Figure 5:
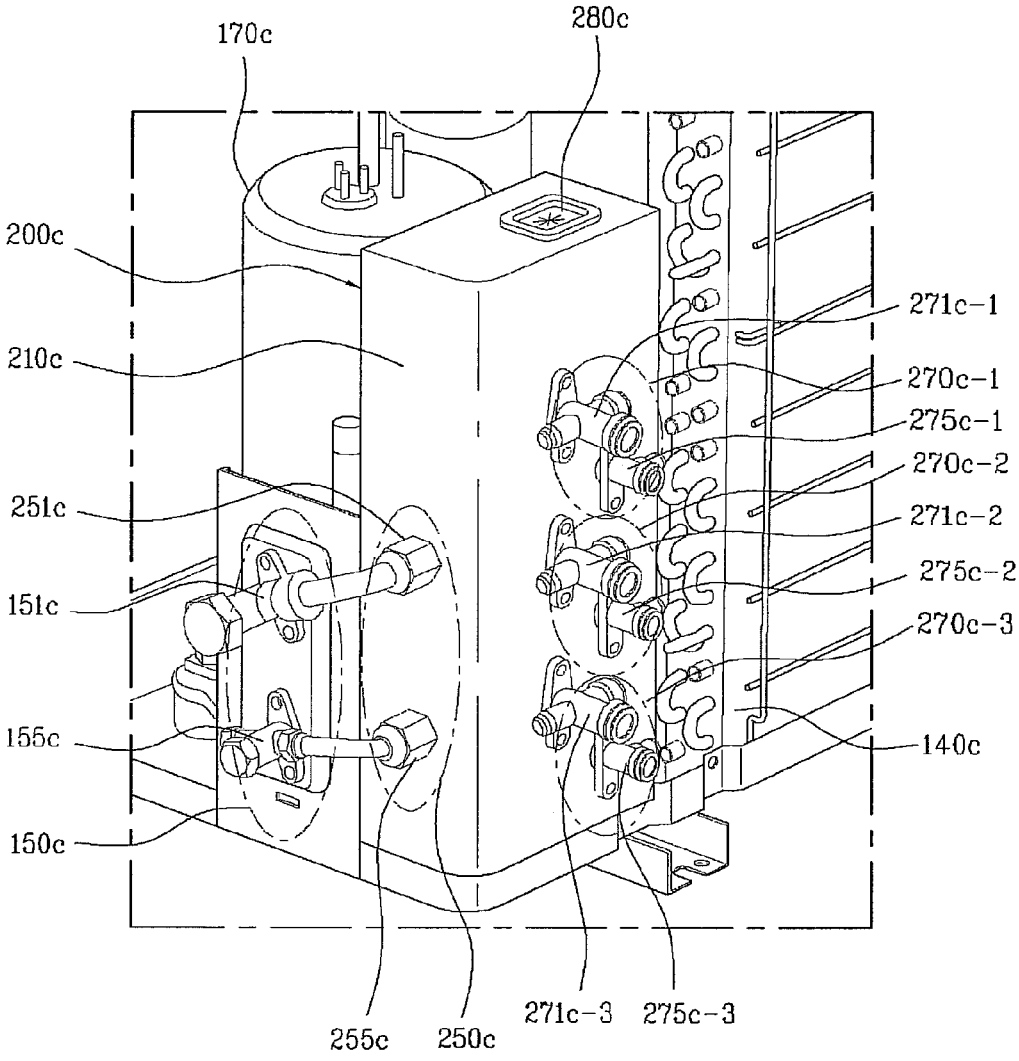
FIG. 5 illustrates a perspective view showing relative positions of components of the distribution unit and the outdoor unit in a state an outdoor unit housing is removed from the outdoor unit of an air conditioner in accordance with a preferred embodiment of the present invention.

FIG. 5 illustrates a perspective view showing relative positions of components of the distribution unit and the outdoor unit with reference to FIGS. 4A and 4B in a state an outdoor unit housing is removed from the outdoor unit of an air conditioner in accordance with a preferred embodiment of the present invention.

In a state the outdoor unit housing is removed from the outdoor unit, since the outdoor heat exchanger 140*c* is arranged in a path through which the outdoor air is drawn and discharged, an inside space of the outdoor unit is not suitable for forming the recessed housing space for mounting the distribution unit 200*c*.

That is, the outdoor unit housing has openings in front/rear of the outdoor unit housing for flow of the outdoor air, it is preferable that the recessed housing space is formed at a position which does not interfere with the outdoor heat exchanger.

The compressor 170*c* is also provided at a position which does not interfere with heat exchange between the outdoor air and the outdoor heat exchanger 140*c*.

The position which does not interfere with arrangement of the compressor 170*c* and the outdoor heat exchanger 140*c* in the space of the outdoor unit housing 110*c* can be corner areas of the outdoor unit housing 110*c*, and, since it is preferable that the distribution unit housing 210*c* has an appropriate length for providing a plurality of the indoor side connection units 270*c* thereto, the recess 120*c* can be formed in the vertical direction corner of the outdoor unit housing.

The distribution unit 200*c* has a plurality of indoor side connection units 270*c* having indoor side high pressure sockets 271*c*-1, 271*c*-2, 271*c*-3 and indoor side low pressure sockets 275*c*-1, 275*c*-2, 275*c*-3, respectively.

FIG. 5 illustrates the indoor side connection unit 270*c* having a first indoor side connection units 270*c*-1, a second indoor side connection units 270*c*-2 and a third indoor side connection units 270*c*-3.

Accordingly, the recessed housing space 130*c* can be arranged in the vicinity of the compressor 170*c*, in the corner areas of the outdoor unit housing 110*c* which have much unused space.

Therefore, referring to FIG. 5, the distribution unit 200*c* can be provided in the vicinity of the compressor 1780*c*.

If the outdoor side connection unit 250*c* is provided in the vicinity of the compressor 170*c* for connection to the outdoor unit 100*c*, lengths of the pipes which connects the outdoor side connection unit 250*c* of the distribution unit 200*c* to the pipe connection unit 150*c* of the outdoor unit 100*c* can be minimized.

Figure 6:
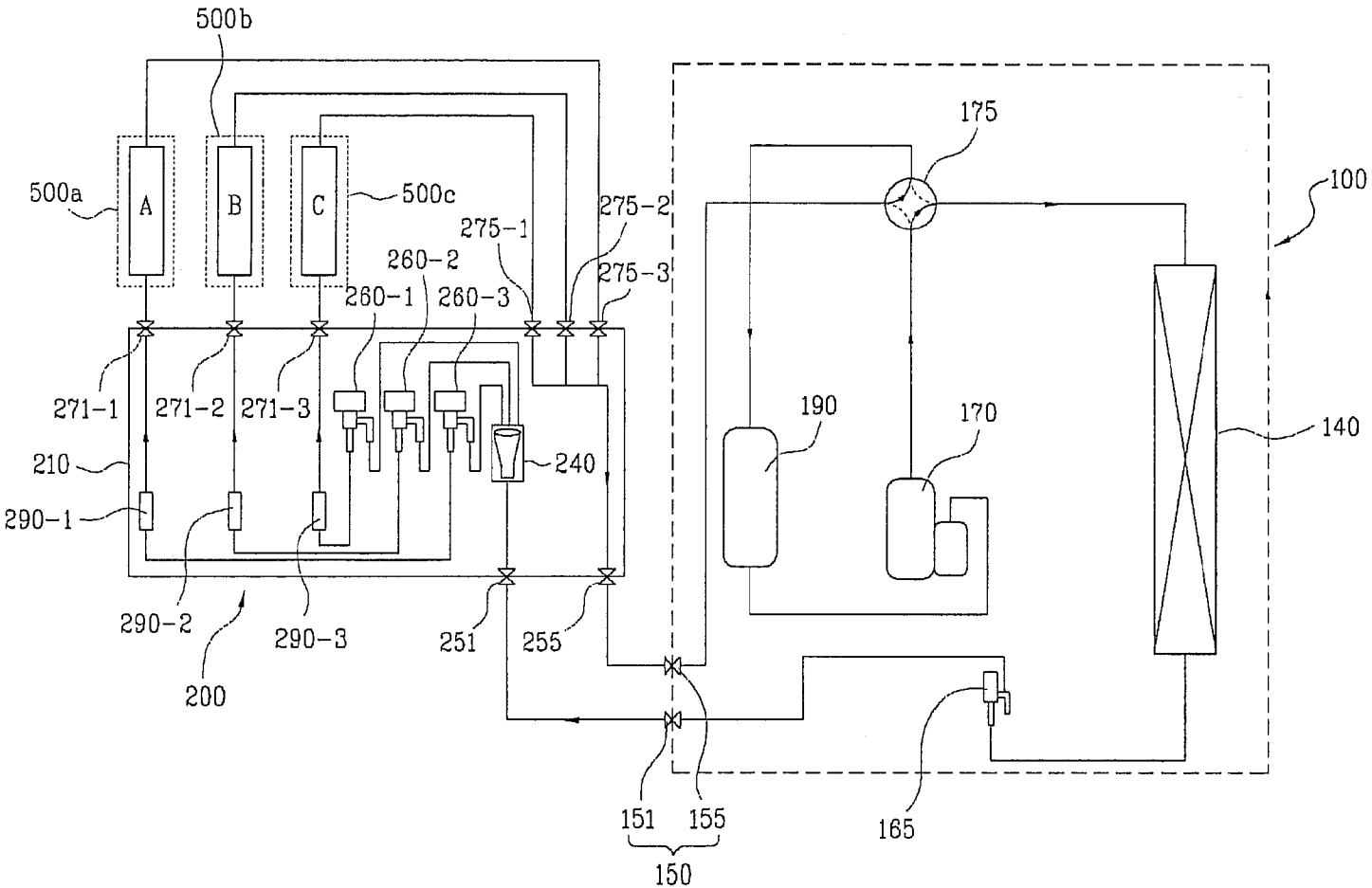
FIG. 6 illustrates a block diagram of an air conditioner in accordance with a preferred embodiment of the present invention.

FIG. 6 illustrates a block diagram of an air conditioner in accordance with a preferred embodiment of the present invention.

Referring to FIG. 6, the air conditioner includes a plurality of indoor units A, B and C, an outdoor unit 100 for supplying refrigerant to the indoor unit A, B and C, and a distribution unit 200 for distributing the refrigerant to the indoor units A, B and C.

The outdoor unit 100 has a compressor 170 for compressing the refrigerant, and an outdoor heat exchanger 140 for making the refrigerant to heat exchange with the outdoor air to condense or evaporate the refrigerant, and an accumulator 190 for separating gaseous refrigerant to liquid refrigerant, additionally.

The outdoor unit 100 may have a four-way valve 175 for changing over a flow direction of the refrigerant according to an operation condition of the spaces to be air conditioned 500*a*, 500*b*, and 500*c*.

Directions marked on the four-way valve 175 show refrigerant flows according to operation conditions of the indoor units A, B, and C, for an example, a cooling operation or a heating operation of the space to be air conditioned, respectively.

If the refrigerant flows in a direction marked with solid lines, the indoor units A, B, and C in the spaces to be air conditioned 500*a*, 500*b*, and 500*c* cool the spaces to be air conditioned respectively, if the refrigerant flows in a direction marked with dashed lines, the indoor units A, B, and C in the spaces to be air conditioned 500*a*, 500*b*, and 500*c* heat the spaces to be air conditioned, respectively.

The outdoor unit 100 may have an expansion valve 165 for reducing a pressure of the refrigerant being supplied to the indoor units A, B, and C, additionally.

The outdoor unit 100 includes the outdoor unit housing which forms an exterior of the outdoor unit 100, and the outdoor unit housing 110 has a pipe connection unit 150 having a high pressure socket 151 and a low pressure socket 155 both for connection to the distribution unit. The high pressure socket 151 of the pipe connection unit 150 is a socket to which the refrigerant passed through the compressor is connected at the time of cooling of the indoor units A, B, and C, and the low pressure socket 155 is a socket to which the refrigerant is recovered to the compressor 170.

The pipe connection unit 150 having the high pressure socket 151 and the low pressure socket 155 is provided to be exposed to an outside on the outdoor unit housing 110. Since description of a mounting position of the pipe connection unit 150 duplicates with the descriptions on FIGS. 2 to 4, the description will be omitted.

The pipe connection unit 150 having the high pressure socket 151 and the low pressure socket 155 is connected to the outdoor side connection unit having the outdoor side high pressure socket 251 and the outdoor side low pressure socket 255.

In the embodiment shown in FIG. 6, though the distribution unit 200 is shown separated from the outdoor unit 100, as described before, the distribution unit can be mounted in a state housed in the recessed housing space in the outdoor unit.

The pipe connection unit 150 at the outdoor unit 100 can be connected to the outdoor side connection unit at the distribution unit 200 with connection pipes which can be detachably mounted thereto, respectively.

Refrigerant flows in the distribution unit will be reviewed assuming that the indoor units A, B, and C installed in the spaces to be air conditioned 500*a*, 500*b*, and 500*c* cool the spaces to be air conditioned 500*a*, 500*b*, and 500*c*.

The refrigerant compressed at the compressor 170 is discharged to the high pressure socket 151 of the pipe connection unit 150 of the outdoor unit 100 after condensed at the outdoor heat exchanger 140, and supplied to the distribution unit 200 through the outdoor side high pressure socket 251 of the distribution unit 200 connected with the connection pipe (not shown) connected to the high pressure socket 151.

The refrigerant supplied to the distribution unit 200 is branched at a number corresponding to a number of the indoor side connection at the distribution unit 200.

A process of the branching of the refrigerant supplied to the distribution unit 200 at a number corresponding to a number of the indoor side connection at the distribution unit 200 is performed by a distributor 240 in the distribution unit 200 to which a plurality of branched pipes can be connected.

The refrigerant distributed by the distributor 240 is selectively expanded at electronic expansion valves 260-1, 260-2, and 260-3 at respective branch pipes according to operations conditions of the spaces to be air conditioned 500*a*, 500*b*, and 500*c* respectively and supplied to the indoor units A, B, and C.

At least one of a front end of the distributor 240 and a rear end of the electronic expansion valves 260-1, 260-2, and 260-3, there may be strainers 290-1, 290-2, and 290-3 for filtering foreign matters.

The electronic expansion valves 260-1, 260-2, and 260-3 can be connected to a control unit with connection wires for controlling the electronic expansion valves 260-1, 260-2, and 260-3.

The indoor units A, B, and C of the multi-air conditioners used widely currently are connected to power sources in the spaces to be air conditioned 500*a*, 500*b*, and 500*c* respectively, and may have a structure for supplying power to the outdoor unit 100 through a power line.

The electronic expansion valves 260-1, 260-2, and 260-3 at the distribution unit 200 are valves of which openings are controlled eclectically according to operation conditions of the indoor units A, B, and C installed in the spaces to be air conditioned 500*a*, 500*b*, and 500*c*, respectively. Since the control unit can have a form of a PCB board (not shown) having a circuit unit, if the control unit is mounted in the distribution unit 200, the control unit can increase a volume of the distribution unit 200.

Therefore, the control unit for controlling the electronic expansion valves 260-1, 260-2, and 260-3 of the distribution unit 200 can be mounted to the outdoor unit 100.

Figure 7:
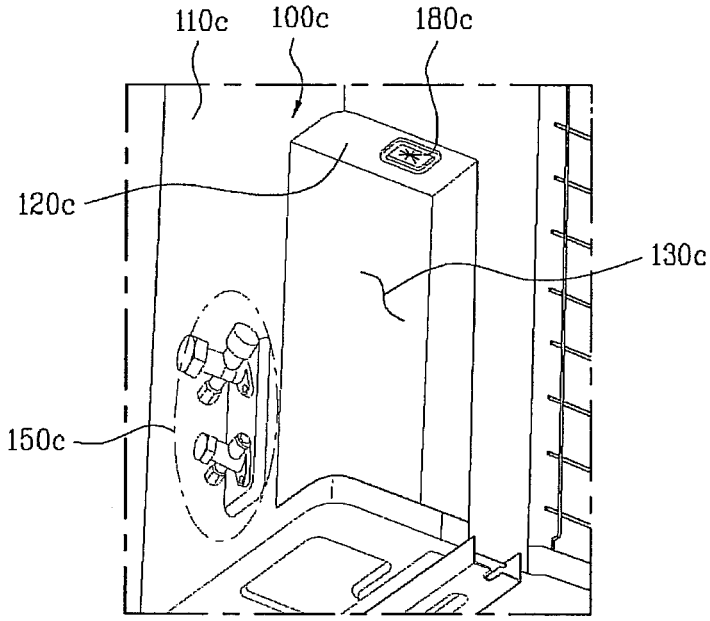
FIGS. 7A and 7B illustrate a perspective view of a recessed housing space in an outdoor unit housing of an outdoor unit of an air conditioner in accordance with a preferred embodiment of the present invention looked up from below the housing space and a perspective view of a distribution unit, respectively.
Figure 7:
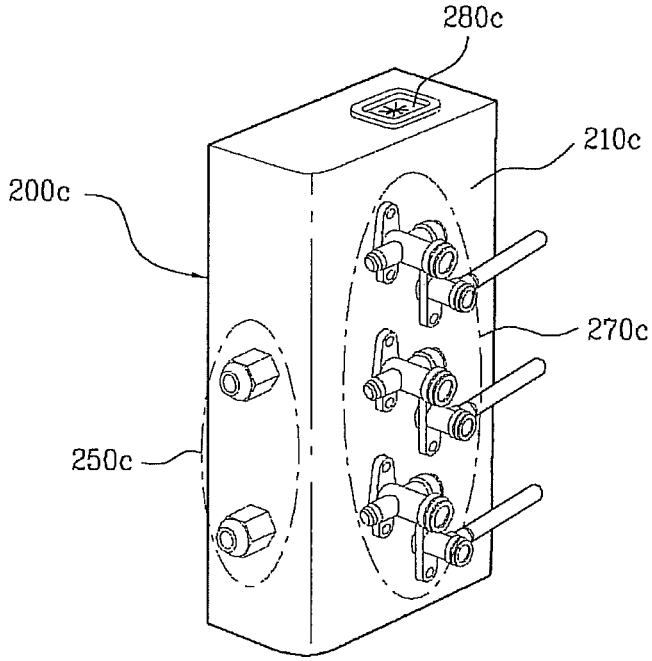

FIG. 7 illustrates a perspective view of a distribution unit of an air conditioner in accordance with a preferred embodiment of the present invention, having fastening brackets mounted thereto for mounting, not to the housing space in the outdoor unit, but to other position.

FIGS. 7A and 7B illustrate a perspective view of a recessed housing space in an outdoor unit housing of an outdoor unit of an air conditioner in accordance with a preferred embodiment of the present invention looked up from below the housing space and a perspective view of a distribution unit, respectively.

The connection wires that connect the PCB board mounted to the outdoor unit 100*c* to the electronic expansion valves at the distribution unit respectively are required to be connected to the electronic expansion valves in the distribution unit housing 210*c* and the outdoor unit housing 110*c* and to the PCB board in the outdoor unit 100*c* respectively, the connection wires can be connected by passing through the outdoor housing and he distribution unit housing.

Accordingly, wire openings 180*c* and 280*c* can be formed in the distribution unit housing 210*c* and the outdoor unit housing 110*c* for passing through of the connection wires, respectively.

As described before, the distribution unit 200*c* may be connected to the outdoor unit 100*c* and the indoor units in a state housed in the outdoor unit housing 110*c*, or separated from the outdoor unit housing for distribution of the refrigerant to the indoor units.

Accordingly, the wire openings 180*c* and 280*c* can be formed at matching positions of an inside of the recess 120*c* in the outdoor unit housing and an outside of the distribution unit housing 210*c* which is to be placed in the recess 120*c* such that the connection wires can pass through the wire openings in the outdoor unit and the distribution unit in a case the distribution unit 200*c* is mounted to the housing space 130*c*.

At the time the wire opening 180*c* in the outdoor unit housing 110*c* and the wire opening 280*c* in the distribution unit housing 210*c* can be in communication when the distribution unit 200*c* is mounted to the housing space 130*c*.

If the wire opening 180*c* in the outdoor unit housing 110*c* and the wire opening 280*c* in the distribution unit housing 210*c* are formed at the matching positions so to be able to communicate with each other, lengths of the connection wires can be minimized, and can prevent the connection wires from exposing to an outside of the outdoor unit housing 110*c* in a state the distribution unit is mounted.

In the embodiment illustrated in FIG. 7, the recessed housing space 130*c* to which the distribution unit 200*c* is mounted is formed in the corner of the outdoor unit housing 110*c*, the wire opening 280*c* in the distribution unit 210*c* is formed in one length direction side of the distribution unit housing 210*c*, and the wire opening 180*c* in the outdoor unit housing 110*c* is also formed opposite to the wire opening 280*c* in the distribution unit housing 210*c*.

Though the wire opening 180*c* in the outdoor unit housing 110*c* and the wire opening 280*c* in the distribution unit 210*c* can be simple openings, a hole may be formed at a center of each of the openings 180*c* and 280*c*, or a rubber packing having a center portion incised in a radial direction may be mounted to each of the openings 180*c* and 280*c* for preventing water or foreign matter from infiltrating therethrough.

If the rubber packing or the like is mounted, a size of a hole through which the foreign matter or the like can infiltrate can be minimized even if a number of the connection wires vary.

Figure 8:
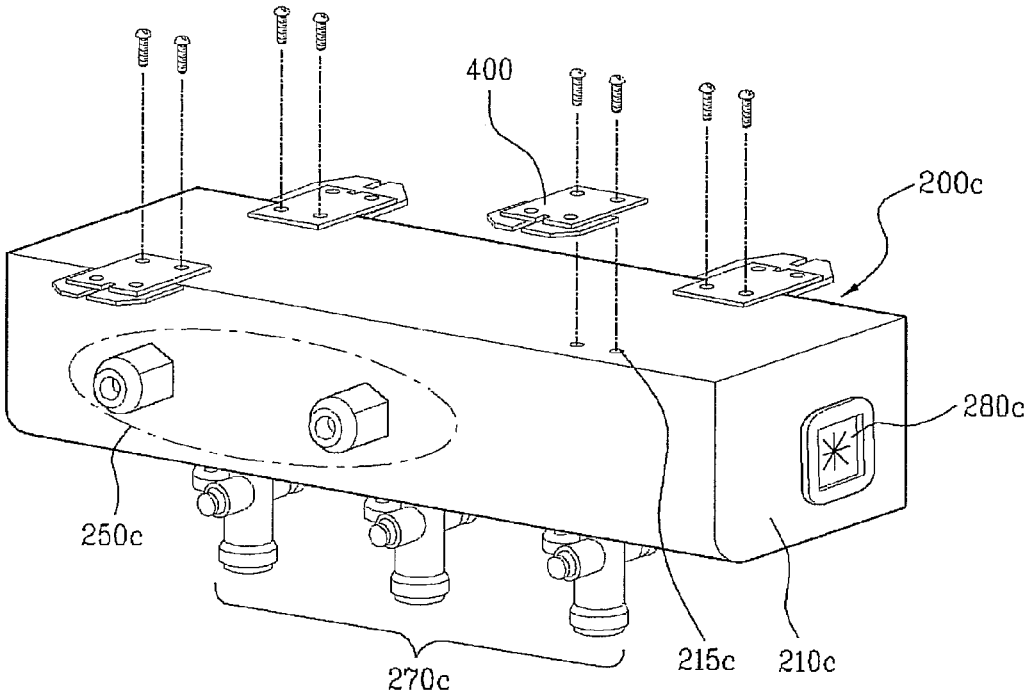
FIG. 8 illustrates a perspective view of a distribution unit of an air conditioner in accordance with a preferred embodiment of the present invention, having fastening brackets mounted thereto for mounting distribution unit, not to the housing space in the outdoor unit, but to other position.

FIG. 8 illustrates a perspective view of a distribution unit of an air conditioner in accordance with a preferred embodiment of the present invention, having fastening brackets 400 mounted thereto for mounting the distribution unit, not to the housing space in the outdoor unit, but to other position.

As described before, the distribution unit 200*c* forms a portion of an exterior of the outdoor unit housing of the outdoor unit and is detachably mounted to the outdoor unit selectively for distribution of the refrigerant to the indoor units. Accordingly, taking conditions of an instillation place of the air conditioner, for an example, a position of the space to be air conditioned, and a direction of an outdoor unit connection unit, into account, the distribution unit 200*c* can be mounted separate from the outdoor unit.

Referring to FIG. 1, a mounting place of the distribution unit can be various positions of wall surfaces (called as a mounting surface). In order to fixedly securing the distribution unit to the wall surface, a plurality of fastening holes 215*c* can be formed in an outside surface of the distribution unit housing 210*c* for fastening the mounting brackets 400 for mounting the distribution unit to the mounting surface.

Since the mounting brackets 400 are means for fixedly securing the distribution unit 200*c* to the mounting surface, in a case the distribution unit 200*c* is mounted to the recessed housing space in the outdoor unit, it is required that the distribution unit 200*c* is detachably fastened to the distribution unit housing 210*c*.

Therefore, it is required that a plurality of the fastening holes 215*c* can be formed in the distribution unit housing 210*c* for fastening the mounting brackets 400 with fastening members (for an example, bolts and the like) thereto.

Referring to FIG. 8, there can be a plurality of fastening holes 215*c* for mounting one mounting bracket 400. For making secure mounting, a plurality of the fastening holes can be formed for mounting one mounting bracket.

Each one of the mounting brackets 400 shown in FIG. 8 is fastened to the distribution unit housing 210*c* with total two fastening members (bolts and the like).

Though the embodiment shown in FIG. 8 illustrates that the fastening holes 215*c* are formed only one side of the distribution unit 200*c*, a direction of the mounting can vary by forming the fastening holes in other sides.

Figure 9:
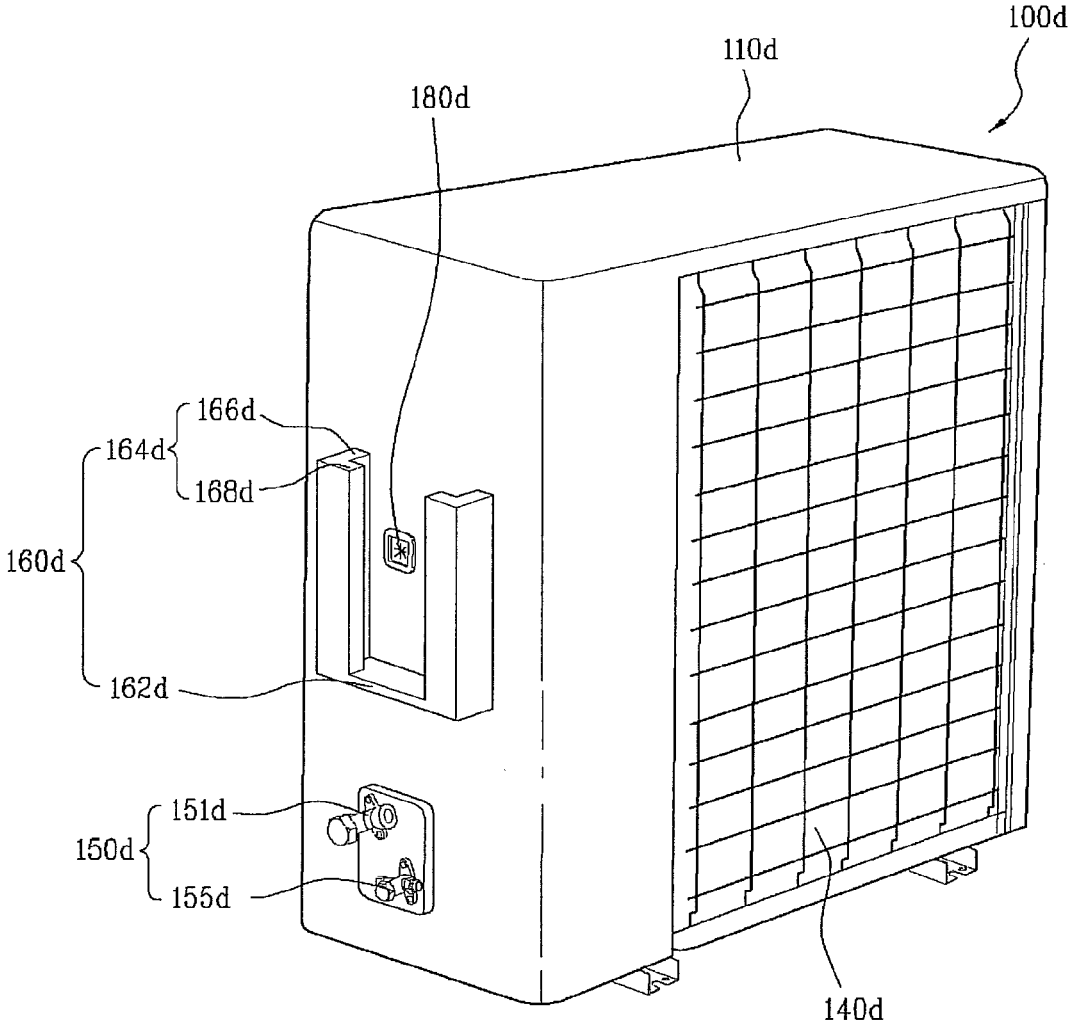
FIG. 9 illustrates a perspective view of an outdoor unit in accordance with another preferred embodiment of the present invention.
Figure 10:
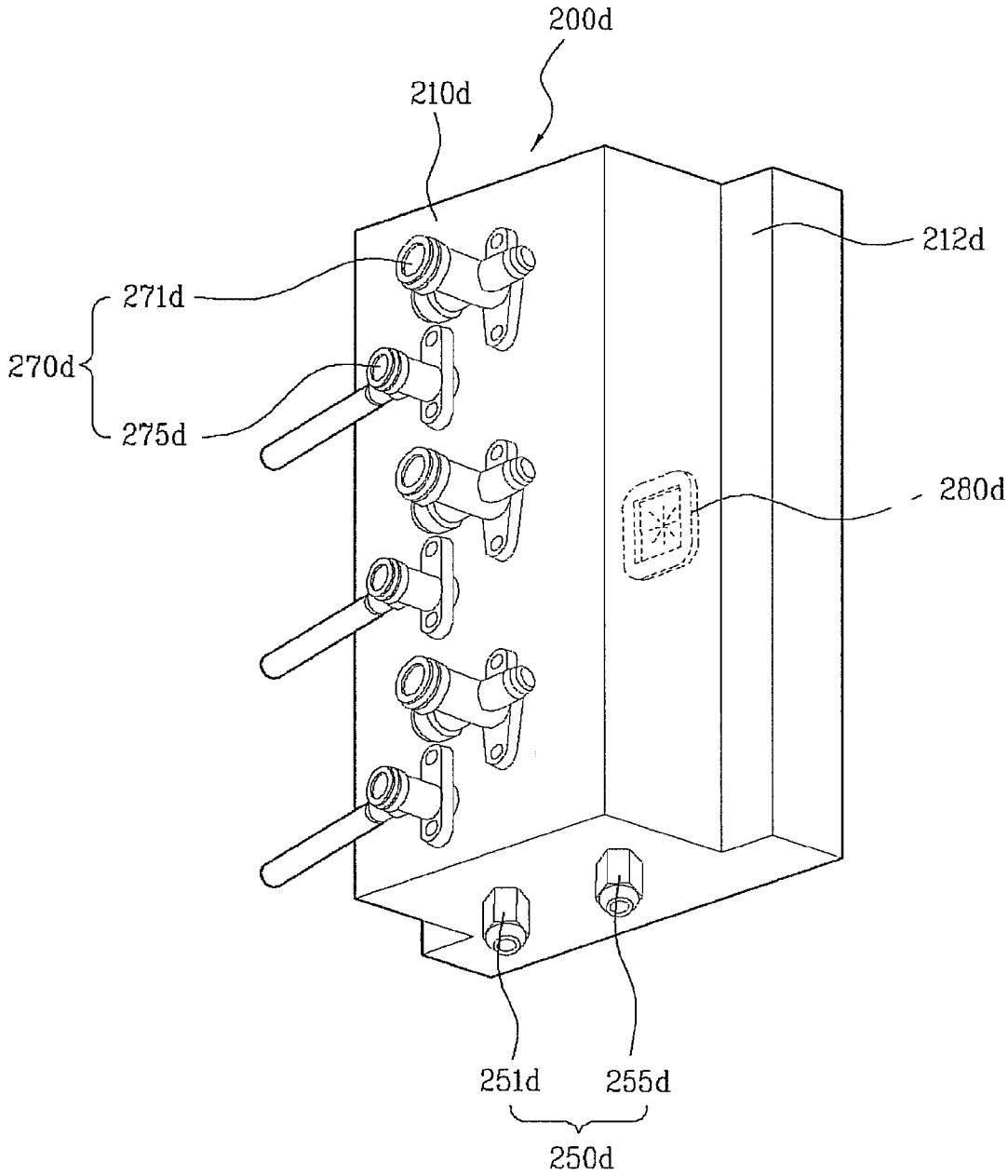
FIG. 10 illustrates a perspective view of a distribution unit in accordance with another preferred embodiment of the present invention.

FIGS. 9 and 10 illustrate perspective views of outdoor units and distribution units of air conditioners in accordance with other preferred embodiments of the present invention, respectively.

The outdoor unit housing 110*d* has a mounting member 160*d* provided to one side thereof. The mounting member 160*d* is provided for securing the distribution unit 200*d* to the outdoor unit housing 110*d*. The mounting member 160*d* has a top side opening for fastening the distribution unit 200*d* starting from the top side. The mounting member 160*d* holds the distribution unit 200*d* mounted to the outdoor unit housing 110*d*.

The mounting member 160*d* includes a stopper 162*d* for supporting a lower end of the distribution unit 200*d*, and one pair of holding ribs 164*d* which are extensions from opposite ends of the stopper 162*d* to surround opposite edges of the distribution unit 200*d*.

That is, if the distribution unit 200*d* is placed in the mounting member 160*d* through the top side opening, the stopper 162*d* supports the distribution unit 200*d* at the lower end to guide a coupling range of the distribution unit 200*d*. The one pair of holding ribs 164*d* hold fastening ribs 212*d* on opposite edges of the distribution unit 200*d* respectively, to secure the distribution unit 200*d*.

The holding rib 164*d* includes a vertical portion 166*d* vertically mounted to the one side of the outdoor unit housing 110*d*, and a holding portion 168*d* at a fore edge of the vertical portion 166*d* for holding the fastening rib 212*d* to prevent the distribution unit 200*d* from falling off.

That is, the vertical portion 166*d* projected from the side of the outdoor unit housing 110*d* vertically for holding a side of the fastening ribs 212*d*, and the holding portion 168*d* at a fore edge of the vertical portion 166*d* parallel to the surface of the outdoor unit housing 110*d* holds one side of the fastening rib 212*d*. The holding portion 168*d* is formed vertical to the vertical portion 166*d*.

Referring to FIGS. 9 and 10, the outdoor unit housing 110*d* and the distribution unit housing 210*d* have wire openings 180*d* and 280*d*, respectively. As described before, the wire openings 180*d* and 280*d* are portions through which connection wires (not shown) pass for transmission/reception of electric signals.

The wire openings 180*d* and 280*d* are formed at facing portions of the outdoor unit 100*d* and the distribution unit 200*d*. Therefore, if the distribution unit 200*d* is mounted to the outdoor unit 100*d*, the wire openings 180*d* and 280*d* can be in communication with each other.

Figure 11:
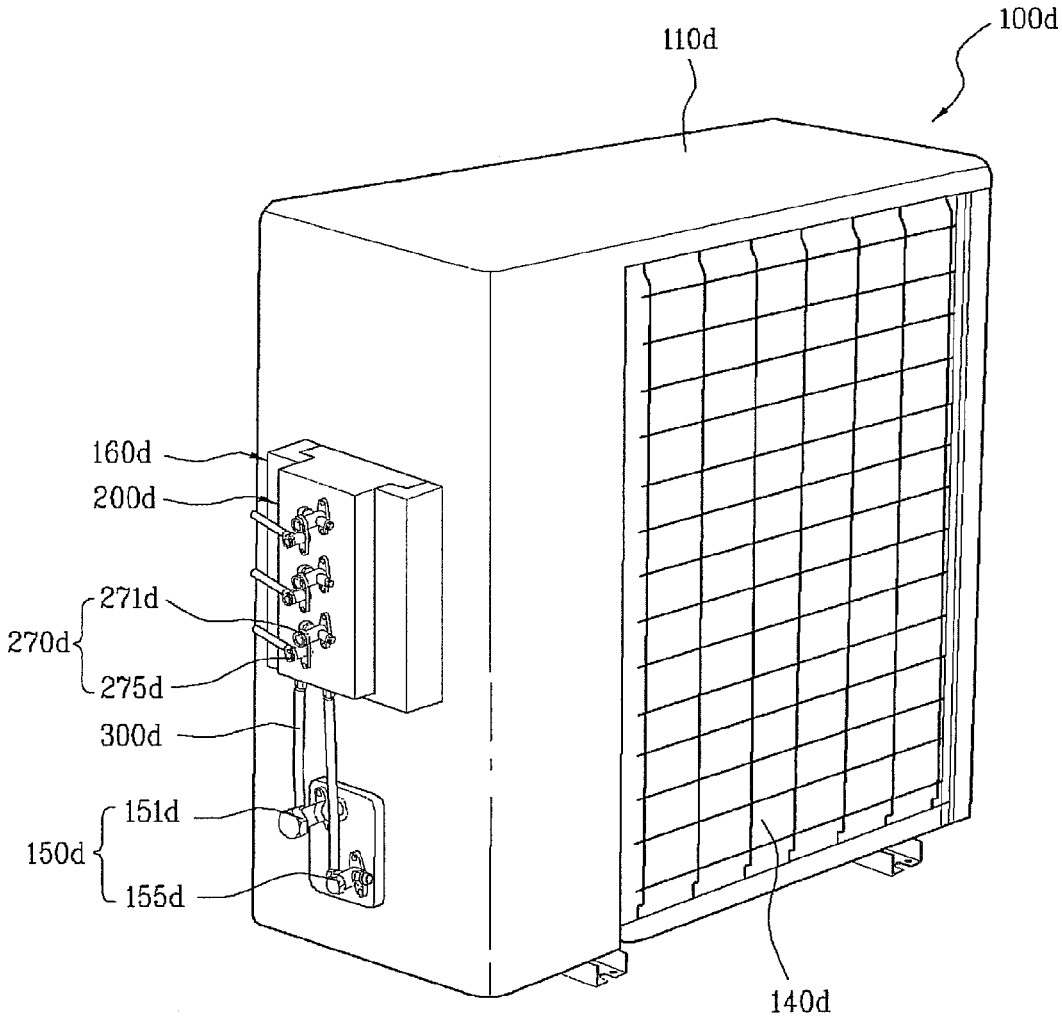
FIG. 11 illustrates a perspective view of a mounted state of a distribution unit to an outdoor unit in accordance with another preferred embodiment of the present invention.

Thus, if the wire opening 180*d* of the outdoor unit 100*d* and the wire opening 280*d* of the distribution unit 200*d* are formed at positions facing each other so as to be in communication with each other, lengths of the connection wires can be minimized, and as shown in FIG. 11, the connection wires do not expose to an outside when the distribution unit 200*d* is mounted to the outdoor unit 100*d*.

Figure 12:
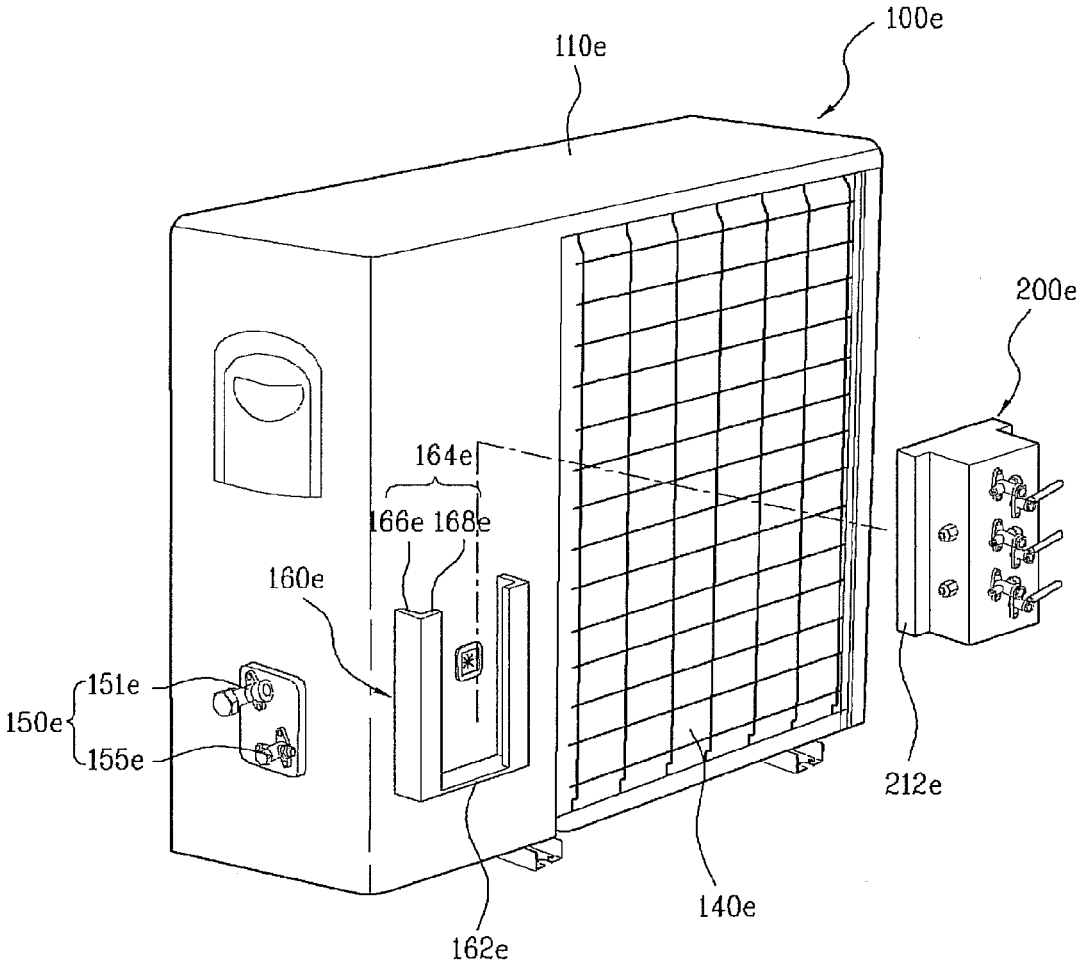
FIG. 12 illustrates a perspective view of a dismounted state of a distribution unit from an outdoor unit in accordance with another preferred embodiment of the present invention.
Figure 13:
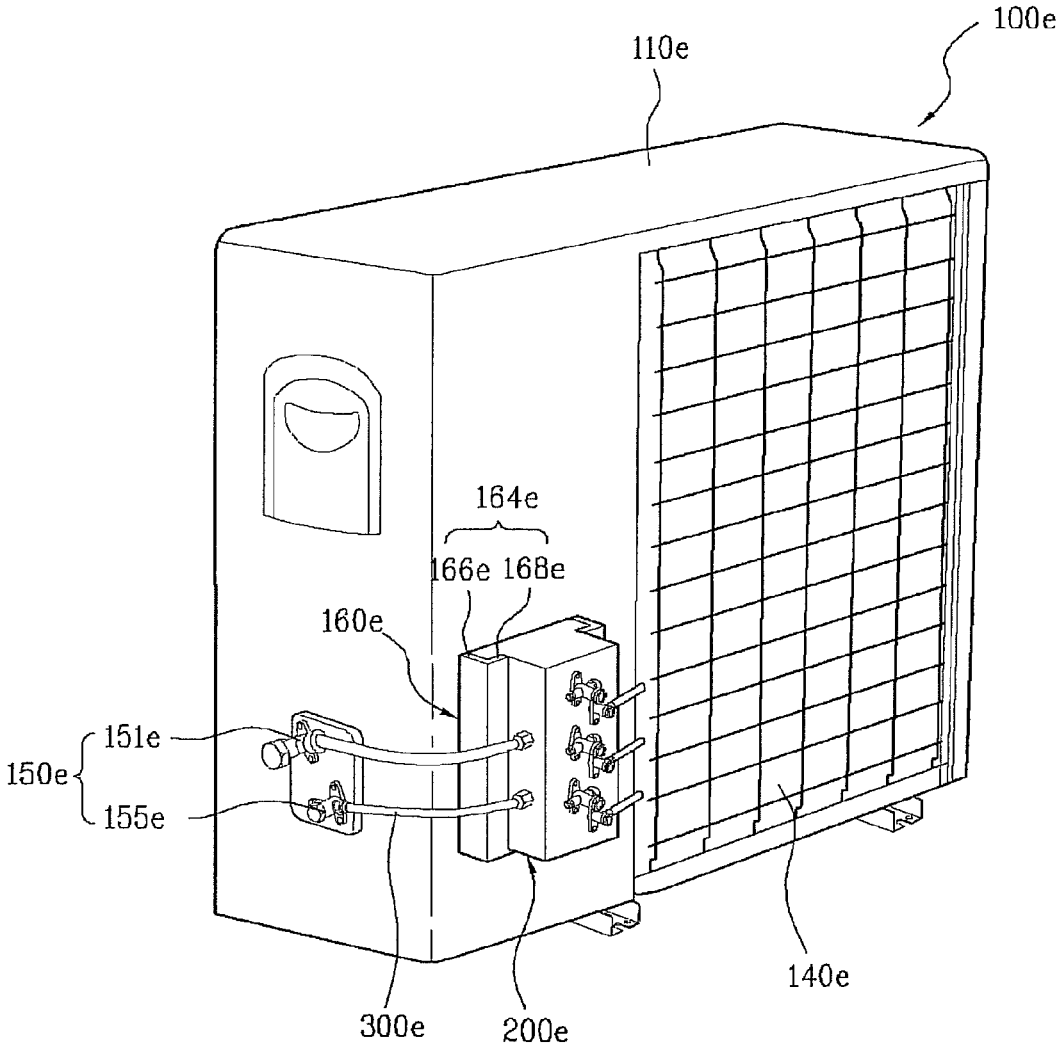
FIG. 13 illustrates a perspective view of a mounted state of a distribution unit to an outdoor unit in accordance with another preferred embodiment of the present invention.

Referring to FIGS. 11 to 13, pipe connection units 150*d* or 150*e* of the outdoor unit 100*d* or 100*e* are connected to the distribution unit 200*d* or 200*e* with detachable connection pipes 300*d* or 300*e*.

The pipe connection units 150*d* or 150*e* include a high pressure socket 151*d* or 151*e* and a low pressure socket 155*d* or 155*e* having different distances from edges of the outdoor unit housing 110*d* or 110*e*. Thus, if the high pressure socket 151*d* or 151*e* and the low pressure socket 155*d* or 155*e* have different distances from a bottom edge and a side edges of the outdoor unit housing 110*d* or 110*e*, the connection pipes 300*d* or 300*e* can be configured brief as other sockets do not interfere with connection paths of the connection pipes 300*d* or 300*e*, even if the distribution unit 200*d* or 200*e* is mounted to a front or a side of the outdoor unit 100*d* or 100*e*.

Moreover, referring to FIGS. 10 and 11, since the high pressure socket 151*d* and the low pressure socket 155*d* are provided to an outside of the outdoor unit housing 110*d* adjacent to an outside of the distribution unit 200*d* having the outdoor side high pressure socket 251*d* and the outdoor side low pressure socket 255*d* provided thereto, pipes exposed to an outside can be simplified, lengths of the connection pipes 300*d* which connect the pipe connection unit 150*d* and the outdoor side connection unit 250*d* can be minimized, and assembly thereof can be convenient.

In the meantime, referring to FIG. 10, the distribution unit housing 210*d* forms an exterior of the distribution unit 200*d*. The distribution unit housing 210*d* is hexahedral, substantially. As described before, the distribution unit 200*d* is mounted on one surface of the outdoor unit housing 110*d* projected therefrom or mounted separated from the outdoor unit housing 110*d*, and connected to the outdoor unit 100*d* and the indoor units, for distribution of the refrigerant to the indoor units.

The distribution unit 200*d* has fastening ribs 212*d* provided thereto. In more detail, the distribution unit 200*d* has the fastening ribs 212*d* formed on opposite edges thereof respectively extended in a length direction of the distribution unit 200*d* for mounting the distribution unit 200*d* to a mounting surface, such as the outdoor unit 100*d* or a wall surface.

That is, referring to FIGS. 9 to 11, The fastening ribs 212*d* are formed in conformity with the holding ribs 164*d* on the mounting member 160*d*. It is preferable that the fastening ribs 212*d* are formed one of sides of the distribution unit housing 210*d* where neither the outdoor side connection unit 250*d* nor the indoor side connection unit 270*d* is provided thereto. The fastening ribs 212*d* are placed in and held by the holding ribs 164*d*, for securing the distribution unit 200*d* to the outdoor unit 100*d*.

The fastening ribs 212*d* may have at least two fastening holes (not shown) for pass through of a fastening piece (not shown) for mounting the distribution unit 200*d* to the outdoor unit 100*d* or the mounting surface. If the fastening hole is formed in the fastening ribs 212*d* thus, the distribution unit 200*d* can be fixedly secured to various positions even if the distribution unit 200*d* has no holding ribs 164*d*.

The distribution unit 200*d* has the outdoor side connection unit 250*d* to be connected to the outdoor unit 100*d* and the plurality of indoor side connection units 270*d* to be connected to the indoor units formed on different sides thereof, for preventing the connection pipes to be respectively connected to the outdoor side connection unit 250*d* and the indoor side connection units 270*d* from interfering with each other.

In the embodiment of the present invention having above configuration, a process for mounting the distribution unit to the outdoor unit will be described, with reference to FIG. 12.

The connection wires which connect the electronic expansion valve 260 in the distribution unit 200*e* to the control unit in the outdoor unit 100*e* are connected through the wire openings 180 and 280 before the distribution unit 200*e* is mounted to the outdoor unit 100*e*. The distribution unit 200*e* is mounted to the outdoor unit 100*e* as the fastening ribs 212*e* are coupled to the mounting member 160*e*.

For this, the distribution unit 200*e* is placed in the mounting member 160*e* through the top side opening of the mounting member 160*e*, and the fastening ribs 212*e* are guided by the holding ribs 164*e* when the distribution unit 200*e* moves down.

If a bottom of the distribution unit 200*e* touches the stopper 162*e* of the mounting member 160*e* as the distribution unit 200*e* moves down, movement of the distribution unit 200*e* stops. In this instance, the bottom of the distribution unit 200*e* is supported by the stopper 162*e*, and the fastening ribs 212*e* are held by the holding ribs 164*e*.

In a state the distribution unit 200*e* is mounted to the outdoor unit 100*e*, the distribution unit 200*e* can be fixedly secured to the outdoor unit 100*e* with the fastening piece, positively. The fastening piece passes through the holding rib 164*e* and the fastening rib 212*e* in succession and fastened thereto, to fixedly secure the distribution unit 200*e* to the outdoor unit 100*e*.

The distribution unit 200*e* can be removed from the outdoor unit 100*e* by a reverse process of above process.

The distribution unit 200*e* removed from the outdoor unit 100*e* can be mounted to an outside of the outdoor unit 100*e* taking installation conditions of the air conditioner, such as a position of the space to be air conditioner and a direction of the pipe connection units 150*e* into account.

Figure 14:
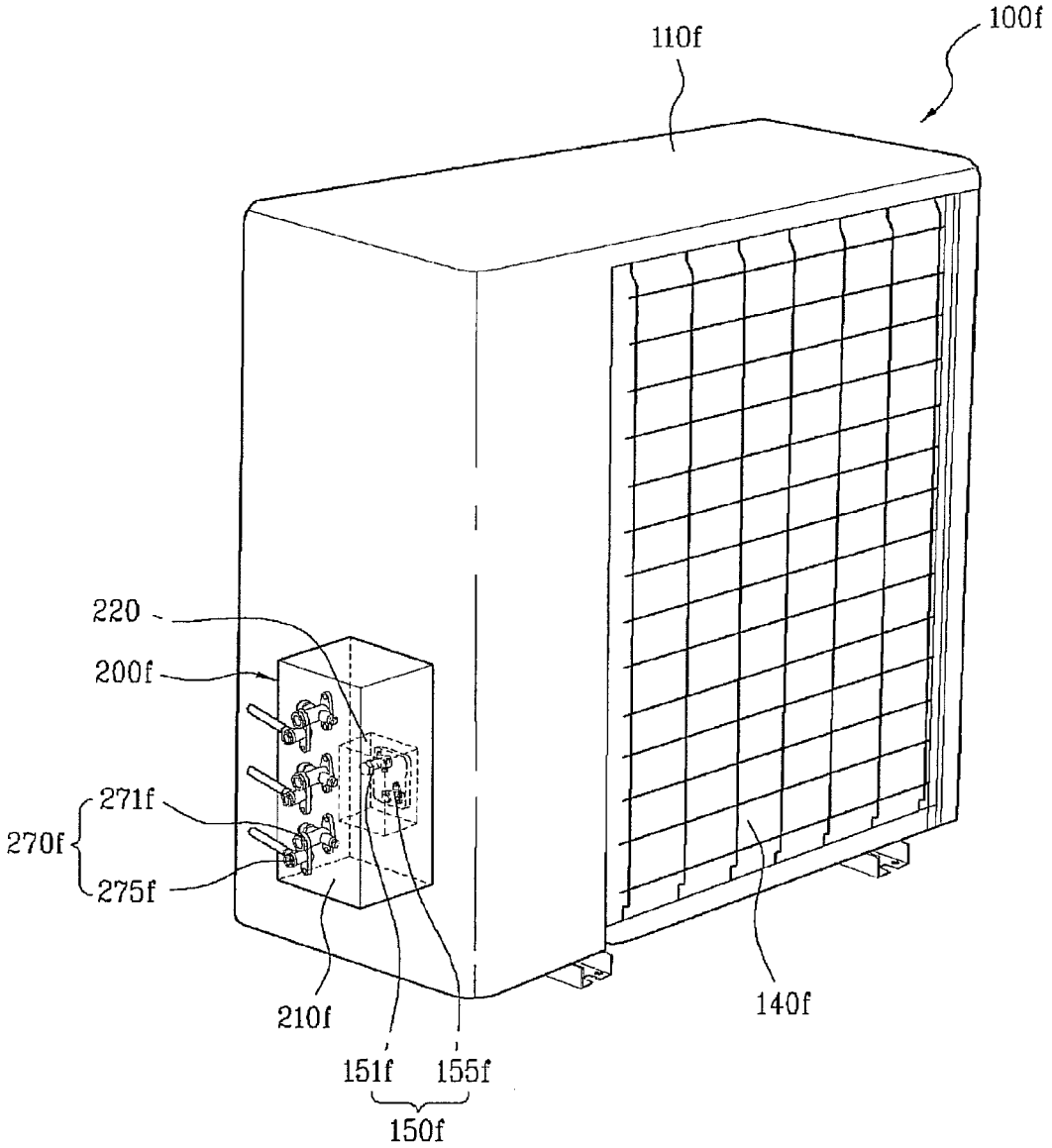
FIG. 14 illustrates a perspective view of a mounted state of a distribution unit to an outdoor unit in accordance with another preferred embodiment of the present invention.

In the meantime, FIG. 14 illustrates a perspective view of an air conditioner in accordance with another preferred embodiment of the present invention.

Referring to FIG. 14, the distribution unit 200*f* has a housing portion 220. The housing portion 220 is a recess in one side of a distribution unit housing 210*f*. The housing portion 220 is provided in conformity with a pipe connection unit 150*f* of an outdoor unit 100*f*. Therefore, if the distribution unit 200*f* is mounted to the outdoor unit housing 110*f*, the pipe connection unit 150*f* is placed in the housing portion of the distribution unit.

The housing portion 220 has a outdoor side connection unit (not shown) to be connected to the pipe connection unit 150*f*, and indoor side connection unit 270*f* to be connected to the indoor units are provided to an outside of the distribution unit 200*f*. The housing portion 220 of the distribution unit 200*f* and the outdoor unit 100*f* have wire openings (not shown) for pass through of the connection wires provided to face each other, respectively.

Thus, if the distribution unit 200*f* has the housing portion 220 formed therein for placing the pipe connection unit 150*f* therein, the pipe connection unit 150*f* is not exposed to an outside of the outdoor unit 100*f* when the distribution unit 200*f* is mounted to the outdoor unit 100*f*.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. An air conditioner comprising:

at least one indoor unit;

an outdoor unit having a compressor and an outdoor unit housing; and a distribution unit having an indoor side connection unit to be connected to the indoor unit and an outdoor side connection unit to be connected to the outdoor unit, wherein the distribution unit includes a distribution unit housing that forms an exterior of the distribution unit, and a plurality of electronic expansion valves disposed in the distribution unit housing, wherein a controller is provided in the outdoor unit for controlling the electronic expansion valves, wherein the outdoor unit housing and the distribution unit housing have wire openings provided therein respectively for pass through of connection wires for connection to the controller and the electronic expansion valves, and wherein the distribution unit housing is mounted to, the outdoor unit detachably, or a mounting surface in a state the distribution unit housing is separate from the outdoor unit.

2. The air conditioner as claimed in claim 1, wherein the distribution unit housing is detachably mounted to a recess in an outside of the outdoor unit housing.

3. The air conditioner as claimed in claim 2, wherein the distribution unit housing has a shape in conformity with the recess in the outdoor unit housing.

4. The air conditioner as claimed in claim 3, wherein the recess in the outdoor unit housing is formed at one corner of the outdoor unit housing.

5. The air conditioner as claimed in claim 4, wherein the corner of the outdoor unit housing having the recess formed therein is in a vicinity of a mounting position of the compressor of the outdoor unit.

6. The air conditioner as claimed in claim 5, wherein the outdoor side connection unit is provided to an outside of the distribution unit mounted to the recess, and the outdoor side connection unit includes an outdoor side high pressure socket and an outdoor side low pressure socket, and a pipe connection unit is provided to an outside of the outdoor unit housing, the pipe connection unit having a high pressure socket and a low pressure socket for connection to the outdoor side high pressure socket and the outdoor side low pressure socket.

7. The air conditioner as claimed in claim 6, wherein the pipe connection unit of the outdoor unit is provided to the outside of the outdoor unit housing that is flush with the outside of the distribution unit having the outdoor side connection unit.

8. The air conditioner as claimed in claim 2, wherein the distribution unit housing has a plurality of fastening holes formed therein for fastening mounting brackets for mounting the distribution unit to the mounting surface in the state the distribution unit is separated from the outdoor unit housing.

9. The air conditioner as claimed in claim 1, wherein the distribution unit housing is detachably mounted to the outside of the outdoor unit housing.

10. The air conditioner as claimed in claim 9, wherein the outdoor unit includes a pipe connection unit to be connected to the distribution unit, wherein the pipe connection unit is provided outside of the outdoor unit housing in a vicinity of a mounting position of the compressor.

11. The air conditioner as claimed in claim 10, wherein the pipe connection unit includes the high pressure socket and the low pressure socket having different distances from edges of the outdoor unit housing.

12. The air conditioner as claimed in claim 9, wherein the distribution unit includes fastening ribs fainted on opposite edges in a length direction of the distribution unit for mounting the distribution unit to the outdoor unit housing or to the mounting surface in a state the distribution unit is separated from the outdoor unit housing.

13. The air conditioner as claimed in claim 12, wherein the outdoor unit housing includes a mounting member provided to the outside thereof, the mounting member having a top side opening for holding the distribution unit.

14. The air conditioner as claimed in claim 13, wherein the mounting member includes:

a stopper for supporting a bottom of the distribution unit, and one pair of holding ribs that are extensions from opposite ends of the stopper for surrounding opposite edges of the distribution unit.

15. The air conditioner as claimed in claim 12, wherein the fastening rib has a plurality of fastening holes formed therein for pass through of fastening pieces respectively for mounting the distribution unit to the outdoor unit housing or to the mounting surface in the state the distribution unit is separated from the outdoor unit housing.

16. The air conditioner as claimed in claim 9, wherein a pipe connection unit is provided to the outside of the outdoor unit housing in a vicinity of the compressor for connection to the distribution unit, and the distribution unit has a recess for placing the pipe connection unit therein.

17. The air conditioner as claimed in claim 1, wherein the wire openings are provided at positions of the outdoor unit and the distribution unit facing each other when the distribution unit is mounted to the outdoor unit.

18. An outdoor unit of an air conditioner comprising:

a compressor for compressing refrigerant;

an outdoor heat exchanger for condensing or evaporating the refrigerant according to operation conditions of at least one indoor unit;

a fan for blowing air for heat exchange with the refrigerant;

an outdoor unit housing for housing the compressor, the outdoor heat exchanger, and the fan therein; and a distribution unit for distributing refrigerant to the at least one indoor unit, wherein the distribution unit is mounted to the outdoor unit detachably, and wherein the distribution unit is mounted to a mounting member provided to an outside of the outdoor unit housing, having a top side opening for holding the distribution unit.

* * * * *